US010363580B2

(12) United States Patent
Bingham et al.

(10) Patent No.: US 10,363,580 B2
(45) Date of Patent: Jul. 30, 2019

(54) RECOVERY HOPPER TROUGH FOR VIBRATORY SEPARATOR AND METHOD

(71) Applicant: M-I L.L.C., Houston, TX (US)

(72) Inventors: Richard Bingham, Katy, TX (US); Colin Stewart, Houston, TX (US); Zakhar Chizhov, Katy, TX (US)

(73) Assignee: M-I L.L.C., Houston, TX (US)

( * ) Notice: Subject to any disclaimer, the term of this patent is extended or adjusted under 35 U.S.C. 154(b) by 0 days.

(21) Appl. No.: 15/528,078

(22) PCT Filed: Nov. 20, 2015

(86) PCT No.: PCT/US2015/061801

§ 371 (c)(1),
(2) Date: May 18, 2017

(87) PCT Pub. No.: WO2016/085797

PCT Pub. Date: Jun. 2, 2016

(65) Prior Publication Data

US 2017/0320100 A1 Nov. 9, 2017

Related U.S. Application Data

(60) Provisional application No. 62/085,063, filed on Nov. 26, 2014.

(51) Int. Cl.
*B07B 13/16* (2006.01)
*E21B 21/06* (2006.01)

(52) U.S. Cl.
CPC ..... *B07B 13/16* (2013.01); *E21B 21/065* (2013.01); *B07B 2201/04* (2013.01); *B07B 2230/01* (2013.01)

(58) Field of Classification Search
CPC .. B07B 1/38; B07B 1/46; B07B 13/16; B07B 2201/04; B07B 2230/01; E21B 21/065
USPC ..... 209/17, 233, 311, 314, 315, 320
See application file for complete search history.

(56) References Cited

U.S. PATENT DOCUMENTS

| | | | |
|---|---|---|---|
| 4,826,251 | A | 5/1989 | Balkus |
| 2004/0245152 | A1 | 12/2004 | Dias |
| 2008/0078699 | A1 | 4/2008 | Carr |
| 2011/0297373 | A1 | 12/2011 | Timmerman et al. |
| 2014/0291216 | A1 | 10/2014 | Brunone |

OTHER PUBLICATIONS

International Preliminary Report on Patentability for the equivalent International patent application PCT/US2015/061801 dated Jun. 8, 2017.

*Primary Examiner* — Joseph C Rodriguez
*Assistant Examiner* — Kalyanavenkateshware Kumar
(74) *Attorney, Agent, or Firm* — Jeffrey D. Frantz

(57) ABSTRACT

An apparatus includes a vibratory separator with a top deck, a middle deck, and a bottom deck, and a collection trough coupled to at least one of the top deck, the middle deck, and the bottom deck. The collection trough includes a collection container having an inlet configured to receive a material retained on the at least one of the top deck, the middle deck, and the bottom deck, and a sloped surface configured to guide the material from the inlet to an outlet of the collection container, and a pressure differential generator disposed proximate the outlet of the collection container.

18 Claims, 6 Drawing Sheets

RECOVERY HOPPER TROUGH FOR VIBRATORY SEPARATOR AND METHOD

CROSS REFERENCE PARAGRAPH

This application claims the benefit of U.S. Provisional Application No. 62/085,063, entitled "RECOVERY HOPPER TROUGH FOR VIBRATORY SEPARATOR AND METHOD," filed Nov. 26, 2015, the disclosure of which is hereby incorporated herein by reference.

BACKGROUND

Various industries, such as oil and gas, mining, agriculture and the like utilize equipment and/or methods to separating fluids from materials. For example, in the mining industry, the separation of a desired mineral component from the undesirable gangue of an ore is a necessary and significant aspect of mining. Tailings are the materials left over after the process of separating the valuable ore from the gangue. Mine tailings are usually produced from a mill in slurry form that is typically a mixture of fine mineral particles and water.

Another example of such a separation method is found in the oil and gas industry. For example, oilfield drilling fluid, often called "mud," serves multiple purposes in the oil and gas industry. Among its many functions, the drilling mud acts as a lubricant for a drilling bit and increases rate of penetration of the drilling bit. The mud is pumped through a bore of the drill string to the drill bit where the mud exits through various nozzles and ports, lubricating the drill bit. After exiting through the nozzles, the "spent" fluid returns to the surface through an annulus formed between the drill string and the drilled wellbore. The returned drilling mud is processed for continued use.

Another purpose of the drilling mud is to carry the cuttings away from the drill bit to the surface. The drilling fluid exiting the borehole from the annulus is a slurry of formation cuttings in drilling mud, and the cutting particulates must be removed before the mud is reused.

One type of apparatus used to remove cuttings and other solid particulates from drilling mud is commonly referred to in the industry as a "shaker" or "shale shaker." The shaker, also known as a vibratory separator, is a vibrating sieve-like table upon which returning used drilling mud is deposited and through which substantially cleaner drilling mud emerges.

Drilling fluids containing bridging materials, also known in the art as wellbore strengthening materials or lost circulation materials (LCM), have seen increased use in drilling operations where natural fractures in the wellbore allow drilling fluid to escape from the circulating system. Wellbore strengthening materials are typically mixed into the drilling fluid and used to bridge the fractures to prevent fluid loss into the formation. Such wellbore strengthening materials are also used in stress cage drilling, which involves intentionally creating fractures in the wellbore and bridging the fractures with the materials.

Wellbore strengthening materials typically are more expensive than other additives used in drilling fluid components. Thus, wellbore strengthening materials may be recovered during waste remediation for reuse.

BRIEF DESCRIPTION OF DRAWINGS

The foregoing and other features of the present disclosure will become more fully apparent from the following description, taken in conjunction with the accompanying drawings.

Understanding that these drawings depict only several embodiments in accordance with the disclosure and are therefore, not to be considered limiting of its scope, the disclosure will be described with additional specificity and detail through use of the accompanying drawings.

DETAILED DESCRIPTION

While some of the example embodiments utilize a vibratory separator in the oilfield industry as an example, the invention should not be deemed as limited to the vibratory separator or the oilfield industry. A person of ordinary skill in the art will appreciate that the embodiments of the disclosure are applicable to other types of separators and other vibratory separators outside of the oilfield industry. The inventors herein contemplate the use of the embodiments disclosed herein in many fields, including industrial screening applications.

In one aspect, embodiments disclosed herein relate generally to a collection system for collecting materials from a vibratory separator. In another aspect, embodiments disclosed herein relate to a collection trough for collecting wellbore strengthening materials from deck of a shaker. More specifically, embodiments disclosed herein relate a collection trough with a pressure differential generator for facilitating removal of the materials in the collection trough out through a discharge conduit.

Vibratory separators use filtration screens to separate solids from fluids and to separate solids of different sizes. For example, shakers use filtration screens to separate drill cuttings from drilling fluid in on-shore and off-shore oilfield drilling. The separating screens have a mesh stretched across a frame. The mesh allows particles and/or fluid below a predetermined size to pass through the separating screen. The separating screen is vibrated while the mixture of particles and/or fluids is deposited on an input side. The vibration improves separation and conveys the remaining particles to a discharge end of the separating screen.

Figure 1:
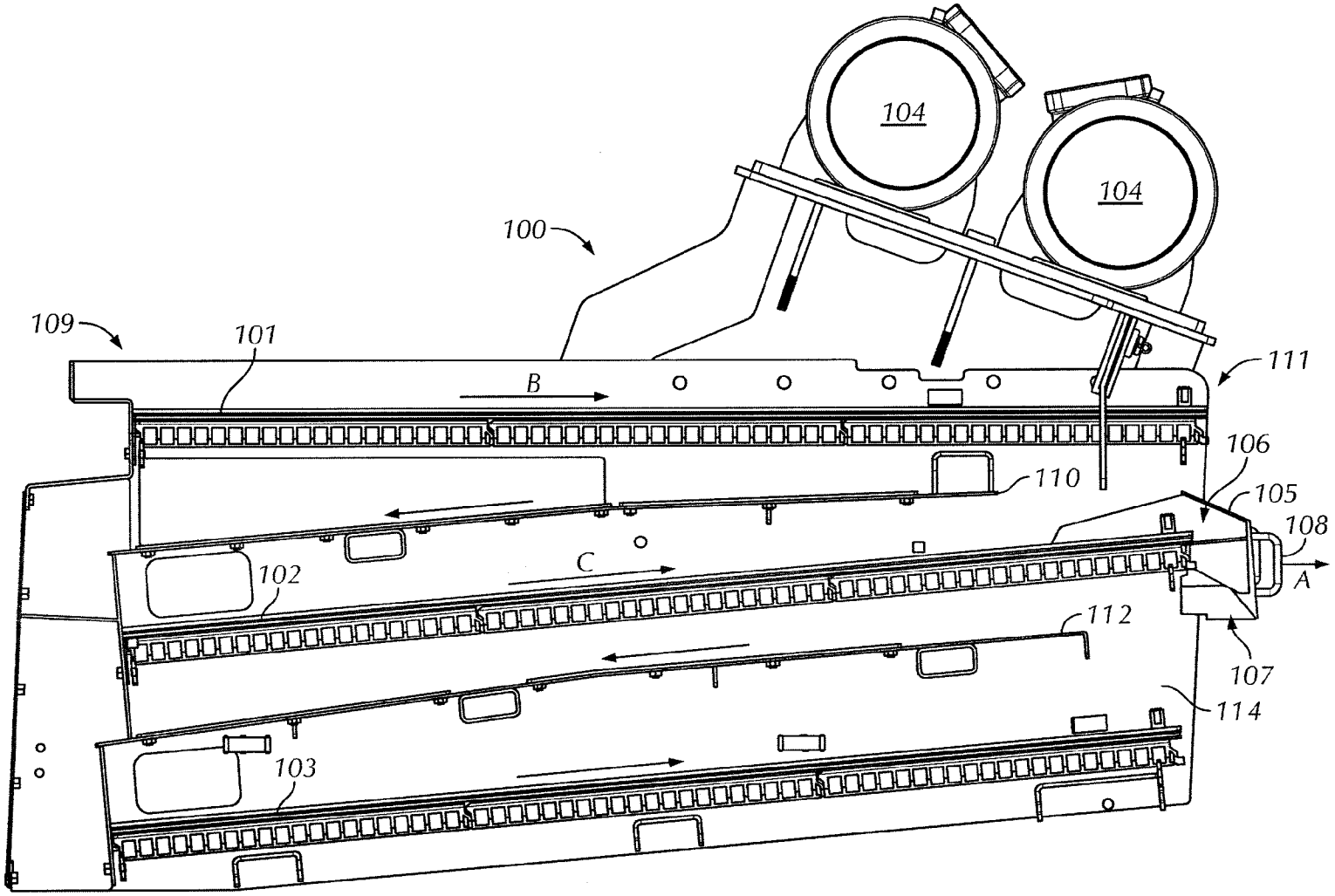
FIG. 1 is a cross-section view of a vibratory separator according to embodiments of the present disclosure.

Referring to FIG. 1, a cross-section plan view of a vibratory separator having a collection trough according to embodiments of the present disclosure is shown. In this embodiment, vibratory separator 100 includes three decks 101, 102, and 103, wherein top deck 101 is a scalping deck, middle deck 102 is a second cut deck, and bottom deck 103 is a fines deck. Vibratory separator 100 also includes two motion actuators 104 configured to provide a motion to decks 101, 102, and 103 during operation. As illustrated, a collection trough 105 is in fluid communication with middle deck 102. Collection trough 105 may be formed from various materials, such as steel, and may include various coatings to prevent corrosion during operation.

Each deck 101, 102, and 103 may include one or more screens (not independently illustrated). The screens include a plurality of perforations of a particular size, thereby allowing fluids and solids entrained therein that are smaller than the size of the perforations to flow through the screens, while particular matter larger than the screen is retained on top of the screen for further processing. Those of ordinary skill in the art will appreciate that the screens on each of decks 101, 102, and 103 may have different perforation sizes, such that the over flow (the retained solids) from each screen are a different sizes. In such an embodiment, the retained solids from deck 101 may be of a larger size than the retained solids from decks 102 and 103. Thus, by selecting different perforation size for screens on decks 101, 102, and 103, a specific solid size from each deck may be retained. Those of ordinary skill in the art will appreciate that depending on the requirements of a reparatory operation, one or more of the screens on decks 101, 102, and/or 103 may also have screens with perforations of the same or substantially the same size.

As drilling fluid containing particulate matter (slurry) enters vibratory separator 100 though an inlet side 109, the slurry flows in direction B, such that fluid and undersized particles form an underflow (i.e., fluids and particulate matter that passes through screens), pass through a screen on first deck 101 and into a first flow back pan 110. The overflow (e.g., drill cuttings or large solids) that did not pass through the screen(s) on first deck 101 may then be discharged from first deck 101 at large particulate discharge point 111. The underflow then flows down first flowback pan 110 and onto deck 102. The mesh used on screens of the deck 102 may be selected such that a predetermined material size or material, such as wellbore strengthening materials, is retained on screen 102. Thus, fluids and particulate matter smaller than the perforations in the screen(s) on deck 102 fall through middle deck 102 screen and onto second flowback pan 112, while wellbore strengthening materials are retained on the screen(s) and moved in direction C.

Vibratory separator 100 also includes a collection trough 105 coupled to at least one of the decks 101, 102, or 103 of vibratory separator 100. The collection trough 105 may be removably coupled or permanently coupled to the vibratory separator 100. In this embodiment, collection trough 105 is illustrated coupled to middle deck 102. As illustrated, collection trough 105 is configured to receive a flow of solid overflow from the second deck 102, which includes solids that are too large to fit through the perforations in a screen on second deck 102. It will be appreciated by those having ordinary skill in the art that the solids may contain liquid material, such as drilling fluid, wellbore fluid, hydrocarbons, water or other fluids. In certain aspects, the solids that are collected in collection trough 105 may include wellbore strengthening materials, such as fluid wellbore strengthening materials that are designed to lower the volume of filtrate that passes through a filter medium and into the formation. Other solids, such as drill cuttings may be entrenched or otherwise conveyed from the vibroatry separator 100 with the wellbore strengthening material. Examples of wellbore strengthening materials, including lost circulation materials, include sized-salts, sized-calcium carbonates, polymers, sand, mica, nutshells (e.g, ground peanut shells and walnut shells), plant fibers, cottonseed hulls, ground rubber, other wellbore strengthening materials known in the art.

Collection trough 105, in this aspect, includes an inlet 106 configured to receive an overflow from the second deck 102 and an outlet 107 configured to direct the overflow to a storage vessel or the active drilling fluid system. The active drilling fluid system may include drilling fluid tanks, mixing tanks, or other containers located at the drilling site, where drilling fluids are mixed and stored prior to use during drilling. Collection trough 105 may include handles 108, which are configured to allow an operator to remove collection trough 105 when either wellbore strengthening materials are not being used or when collection of such wellbore strengthening materials is not required. In certain aspects, it may be desirable for the separatory operation to continue without the collection of wellbore strengthening materials. In such an operation, the operator may simply remove collection trough 105 from second deck 102 by sliding collection trough 105 in direction A. In certain embodiments, collection trough 105 may be secured to second deck through mechanical attachment points, such as bolts or screws, while in other aspects, collection trough 105 may be secured to deck 102 through a pneumatic actuation system, such as pneumatic systems typically used to secure screens to decks.

Those of ordinary skill in the art will appreciate that collection trough 105 may be disposed on other decks, such as first deck 101 or third deck 103 in certain separatory operations. For example, in a return flow of drilling fluid with high solids content, it may be beneficial to collect wellbore strengthening materials from third deck 103, while in other operations, it may be beneficial to collect wellbore strengthening materials from first deck 101. In still other aspects, a collection trough may be used on more than one deck to collect multiple sized wellbore strengthening materials. Additionally, the location of collection trough 105 may be selected based on the perforation size of the screens on a particular deck or based on the size of the wellbore strengthening materials being collected.

Fluids and particulate matter that is smaller than a perforation size of a screen on deck 102 do not enter collection trough 105; rather, the fluids and fine particulate matter pass through the screen on middle deck 102 onto flow back pan 112. In a final separatory action, fluids and particulate matter smaller than a screen on deck 103 flow through the screen into a reservoir or sump in vibratory separator 100 that is in fluid communication with the active drilling fluid system. Fines that are larger than the perforation on screens disposed on the bottom deck 103 are discharged from the vibratory separator at discharge point 114 for disposal thereafter.

In certain applications the flow through vibratory separator 100 may be modified by, for example, providing for a bypass of one or more of the decks 101, 102, and/or 103. Additionally, series and/or parallel flow may be achieved by diverting a flow of fluid around one or more of decks 101, 102, 103, or away from one or more of flow back pans 110 and/or 112.

Figure 2:
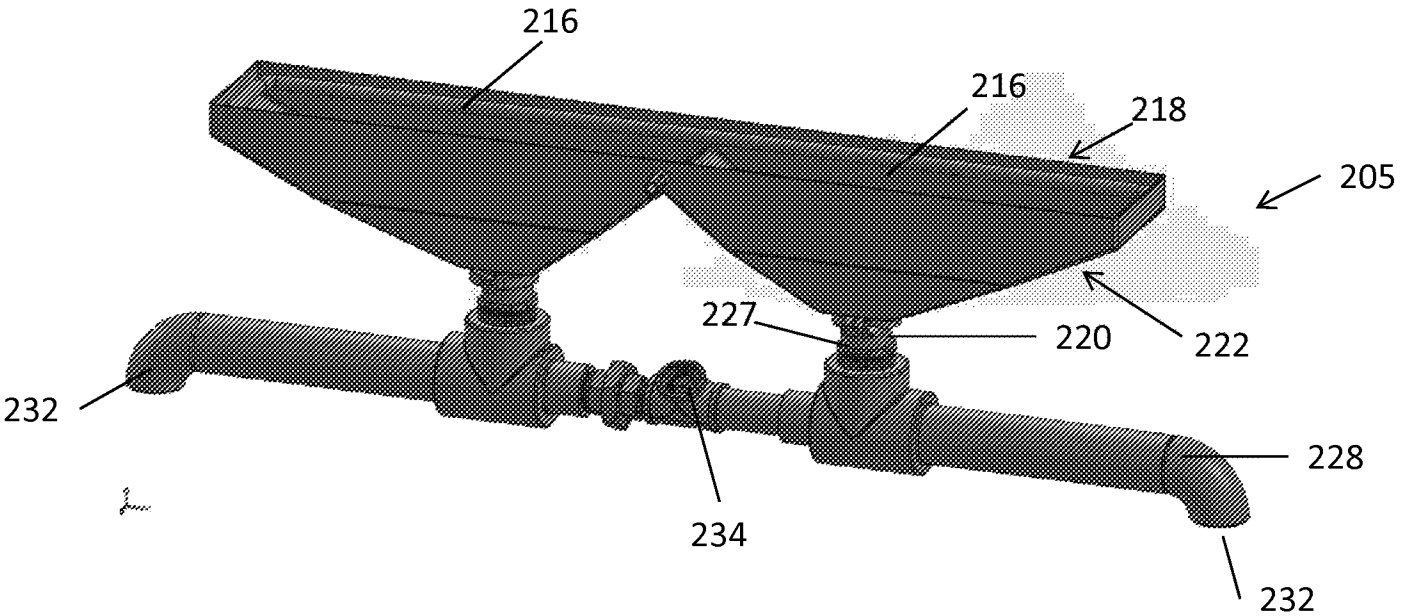
FIG. 2 is a perspective view of a collection trough for a vibratory separator in accordance with embodiments of the present disclosure.

Referring to FIG. 2, a side perspective view of a collection trough 205 in accordance with embodiments of the present disclosure is shown. Collection trough 205 may include one or more hoppers 216. As shown in FIG. 2, collection trough 205 includes two hoppers 216. Hopper 216 is a collection container having an inlet 218 and an outlet 220. Inlet 218 is configured to receive material retained on a screen surface of a deck (not shown) of a vibratory separator (e.g., 100 in FIG. 1). Hopper 216 further includes at least one sloped surface 222 configured to guide the material collected in the hopper from the inlet 218 to the outlet 220. For example, hopper 216 may include one or more sloped surfaces 222 to funnel materials collected down to and out outlet 220. Each hopper 216 may include a single outlet 220. Outlet 22 may be an opening formed in or proximate to the sloped surface 222.

Figure 3:
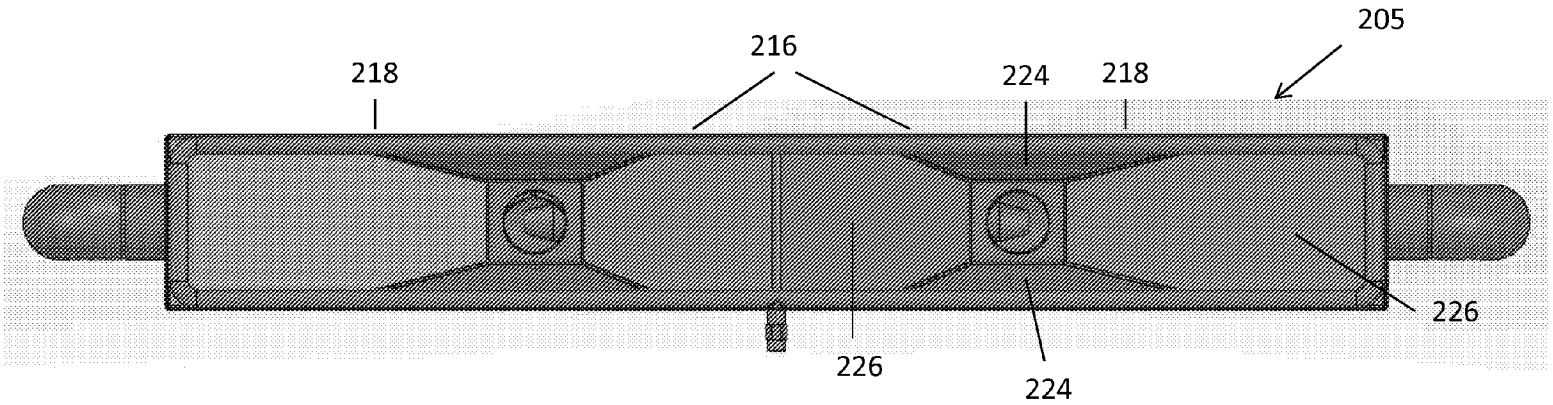
FIG. 3 is a top view of the collection trough of FIG. 2.

FIG. 3 shows a top view of the collection trough 205 of FIG. 2 having two hoppers 216. As shown, the inlet 218 of each hopper 216 may be generally rectangular defining a perimeter of the opening of the hopper 216. The side surfaces 224 and end surfaces 226 extend downward from the inlet 218 to the outlet 220, to collect the material and convey the collected material out of the hopper. As shown, each hopper 216 may have a generally rectangular cross-sectional shape. As such, each hopper 216 may include two side surfaces 224 and two end surfaces 226. At least one of the surfaces (i.e., the two side surfaces 224 and two end surfaces 226) includes a sloped surface. The sloped surface angles toward the outlet 220. The sloped surface may include a linear or curvilinear (convex or concave) surface. In some embodiments, each of the two side surfaces 224 and each of two end surfaces 226 include a sloped surface angling down toward the outlet 220. The two hoppers 216 may be positioned next to one another, end to end, to form an elongated collection trough 205. One of ordinary skill in the art will appreciate that, in some embodiments, more than two hoppers 216 may be positioned next to one another. Further, in embodiments where the collection trough 205 includes more than one hopper 216, the hoppers 216 may be integrally formed or formed separately and coupled (removably or permanently) together, such as by bolting, other mechanical fasteners, welding, etc. A length of the collection trough 205 may be approximately equal to a width of a screening surface of a deck (not shown) of a vibratory separator (e.g., 100, FIG. 1) such that the collection trough 205 may collect substantially all of the material retained on the screening surface of the deck and exiting the vibratory separator. Although the hoppers 216 are described as having a generally rectangular shape, one of ordinary skill in the art will appreciate that the hopper 216, and the collection trough 205, may have any shape, such as square, oval, etc., without departing from the scope of embodiments disclosed herein.

Referring to FIG. 2, collection trough 205 further includes a discharge pipe or conduit 228 coupled to the outlet 220 of the hopper 216. In embodiments where the collection trough 205 includes two or more hoppers 216, the conduit 228 is coupled to the outlet 220 of each hopper 216. Thus, the hoppers 216 are in fluid communication via the conduit 228. The conduit 228 extends parallel to the length of the collection trough 205. The conduit 228 may be coupled to the outlets 220 by any means known in the art, for example, threaded couplings or the like. In some embodiments, a joint 227 or section of pipe may connect the outlet 220 of the hopper 216 to the conduit 228. In other words, joint 227 provides fluid communication between the outlet 220 of the hopper 216 and the conduit 228. One of ordinary skill in the art will appreciate that conduit 228 may include an assembly of joints or sections of pipe, fittings, couplings, etc. as known in the art to provide connection and fluid communication between the conduit 228 and various outer other components, including, for example, the hoppers, a fluid source (as discussed below), discharge end 232 and/or discharge conduits, storage vessels, etc.

The conduit 228 includes at least one discharge end 232. As shown in FIG. 2, in some embodiments, the conduit 228 includes two discharge ends 232, one located at each end of the conduit 228. The discharge ends 232 may be in fluid communication with a sump (not shown) of the vibratory separator (e.g., 100, FIG. 1), a storage vessel, or an active drilling fluid system. Thus, material (such as wellbore strengthening materials) collected in the hoppers 216 from the screening surface of the deck (not shown) may be conveyed through the conduit 228 through the discharge ends 232, and disposed of or reused. The size of the conduit 228 and discharge ends 232 may be selected to facilitate conveyance of the collected material therethrough. For example, in some embodiments, the conduit 228 and/or discharge ends 232 may be 4, inches in diameter, 5 inches in diameter, 6 inches in diameter, 7 inches in diameter, etc. One of ordinary skill in the art will appreciate that the size of the conduit 228 and/or a discharge ends 232 is not intended to limit the scope of embodiments disclosed herein.

Figure 4:
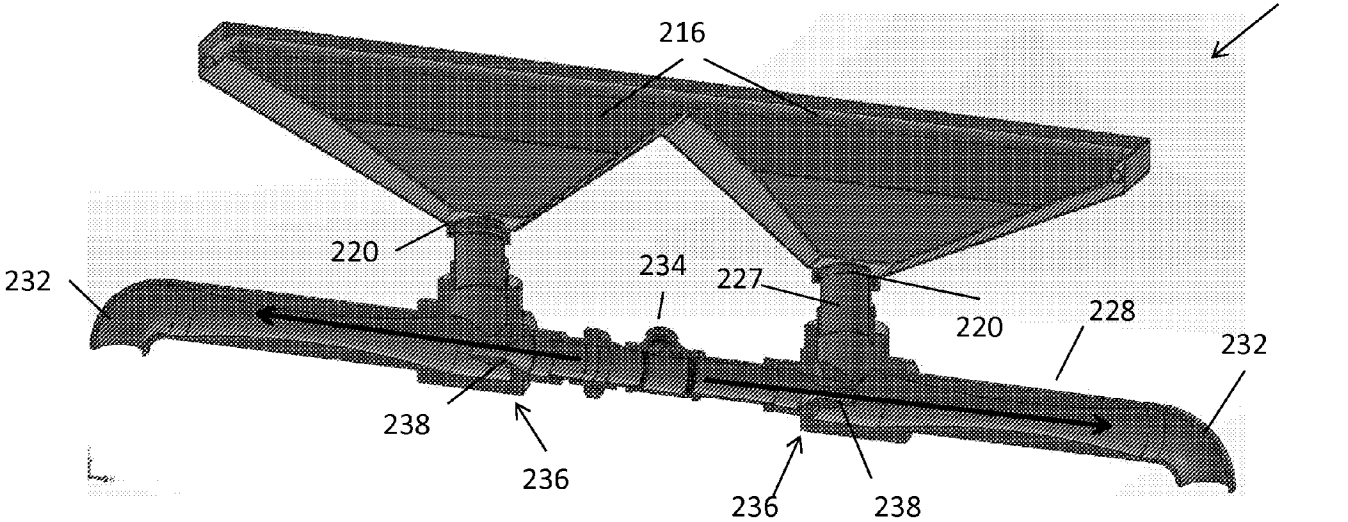
FIG. 4 is a cut away view of the collection trough of FIG. 2.

Conduit 228 may include a fluid inlet 234 configured to receive a flow of fluid from a fluid source to facilitate movement of the materials collected from the hoppers 216 and through the conduit 228 to the discharge end 232. Fluid injected through the fluid inlet 234 may any fluid including but not limited to water, clean drilling muds, including water-based and oil-based muds, recycled or processed drilling muds, etc. Referring to FIGS. 2 and 4 together, in some embodiments, the collection trough 205 may include an eductor 236 coupled to the outlet 220 of the hopper 216. Eductor 236 may be a separate component coupled between the outlet 220 of the hopper 216 and the conduit 228 or the eductor 236 may be formed in or as a part of conduit 228. In some embodiments, the outlet 220 and/or coupling joint 227 may couple directly to the eductor 236, where the eductor 236 is a component separate from but coupled to the conduit 228, such that the eductor 236 and conduit 228 together form a continuous conduit or flow path. In embodiments where the collection trough 205 includes more than one hopper 216, the collection trough 205 may include more than one eductor 236 such that one eductor 236 is coupled to each outlet 220 of each hopper 216. In other embodiments, only one of many hoppers 216 may include an eductor 236 coupled to the outlet 220.

As shown in FIG. 4, which is a cut away view of collection trough 205 in accordance with embodiments disclosed herein, eductor 236 includes a tapered nozzle 238 or eductor jet such that the nozzle tapers in the direction of the discharge end 232 of the conduit 228. In some embodiments, eductor 236 may include more than one tapered nozzle. One of ordinary skill in the art will appreciate that the shape and size of the eductors 236 may vary without departing from the scope of embodiments disclosed herein. Further, the fluid inlet 234 is located upstream of the eductor 236. Thus, fluid provided through fluid inlet 234 flows through conduit 228 into the eductor 236 and through the tapered nozzle of the eductor 236 toward the discharge end 232 of the conduit 228. In some embodiments, the tapered nozzle 238 of the eductor 236 is positioned proximate the outlet 220 of the hopper. For example, as shown in FIG. 4, with reference to the hopper 216 shown on the right hand side of the figure, the eductor 236 is positioned below the outlet 220 of the hopper 216 and below the coupling joint 227 that fluid couples the outlet 220 to the conduit 228. The tapered nozzle 238 of the eductor 236 is positioned below or proximate an entrance of an opening in the conduit 228 connected to the outlet 220 of the hopper 216 (and/or joint 227) and tapers in the direction of fluid flow (from fluid inlet 234 to discharge end 232), as shown by the arrow.

Fluid is injected into conduit 228 through fluid inlet 234 and through eductor 236. Flow of pressurized fluid through the tapered nozzle 238 of the eductor 236 creates a pressure differential in the conduit 228 from an inlet to an exit end of the eductor 236. Thus, the flow of pressurized fluid through the tapered nozzle 238 of the eductor 236 creates suction in the conduit 228 proximate an exit end of the eductor 236 (i.e., narrower end of the tapered nozzle 238) due to the Venturi effect. Thus, by positioning the eductor 236 below or at the entrance of the coupling of the hopper 216 to the conduit 228, pressurized fluid flow through the eductor 236 creates suction (or a pressure differential) that draws the material collected by the hopper 216 through the outlet 220 of the hopper 216 and into the conduit 228. The pressurized fluid flow from the eductor 236 and through the conduit 228 can aid in moving the material through the conduit 228 to the discharge end 232. Although reference herein is made to an eductor, one of ordinary skill in the art will appreciate that any pressure differential generator may be coupled to the hopper 216 such that a pressure differential is created proximate an exit side of the outlet 220 of the hopper 216 to create suction of the material inside the hopper 216. The pressure differential generator may include, for example, an air amplifier and/or a line vacuum.

Figure 7:
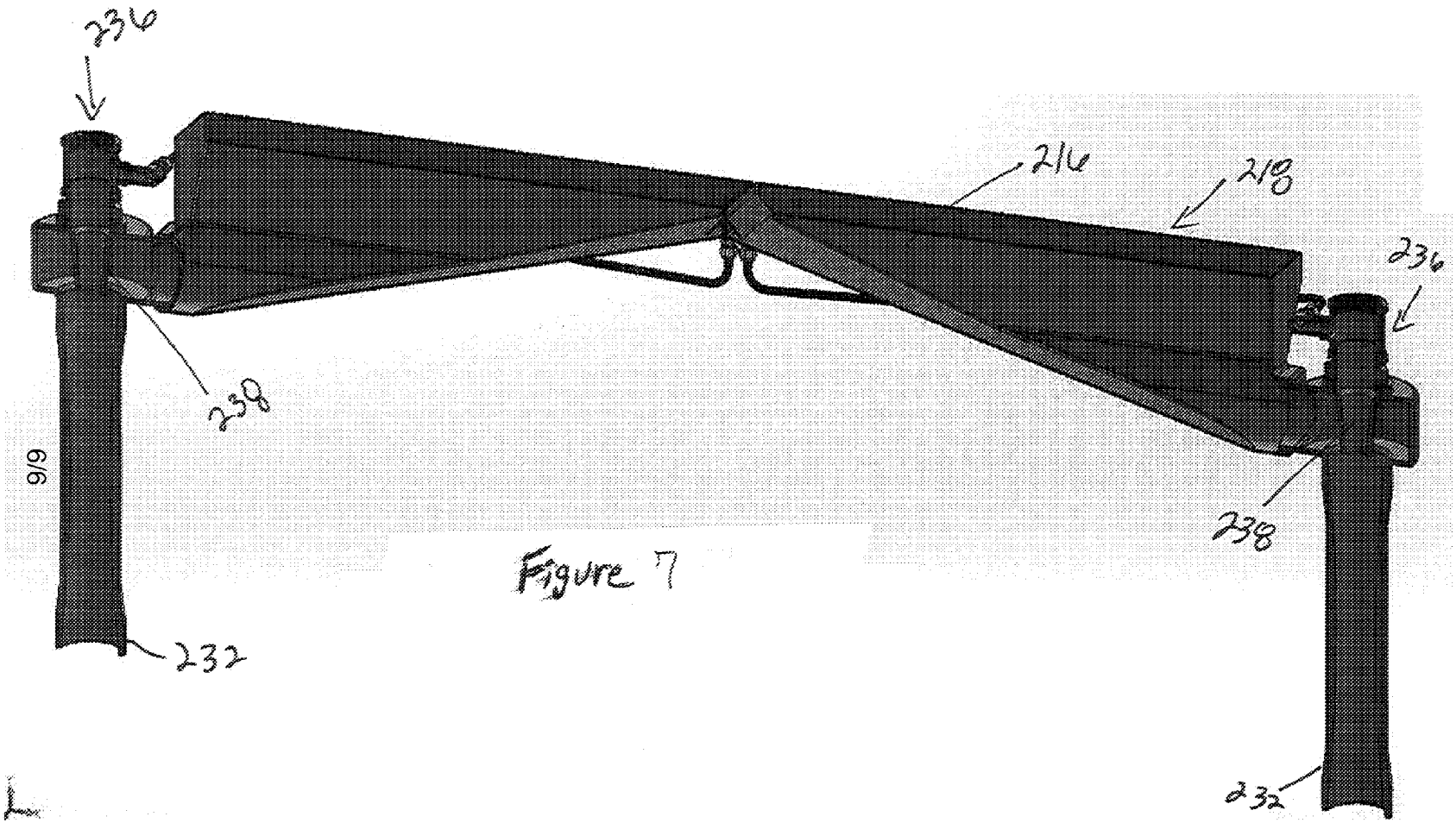
FIG. 7 illustrates a collection trough for a vibratory separator having vertically arranged eductors in accordance with embodiments of the present disclosure.

FIG. 7 illustrates the eductors 236 arranged vertically in accordance with some embodiments of the disclosure. The educators 236 can create suction or a pressure differential as described above across the hopper 216.

In embodiments with two hoppers 216 and two discharge ends 216 at opposite ends of the collection trough 205, as shown in FIG. 4, the fluid inlet 234 may be positioned between the hoppers 216 and configured to provide a flow of fluid into the conduit 228 directed to both discharge ends 232, as shown by the arrows. As shown, the collection trough may include two eductors 236, one positioned below or proximate an entrance of an opening in the conduit 228 to each of the hoppers 216 in the direction of fluid flow (from fluid inlet 234 to discharge end 232), as shown by the arrows. In some embodiments, the eductors 236 below each of the hoppers 236 may be the same, and therefore provide similar pressure differentials given the same inlet fluid flow. In other embodiments, a first eductor coupled to a first hopper may be different (for example, in size, shape, configuration) than a second eductor coupled to a second hopper.

Fluid is injected into conduit 228 through fluid inlet 234 and through eductors 236. Each eductor 236 includes a tapered nozzle 238 or eductor jet such that the nozzle tapers in the direction of the discharge ends 232 of the conduit 228. Thus, as shown, the tapered nozzles 238 of the eductors 236 are oriented oppositely such that the tapered nozzle of the eductor 236 proximate the outlet 220 of the hopper 216 on the left side of the figure tapers toward the discharge outlet 232 on the left side of the figure, and the eductor 236 proximate the outlet 220 of the hopper 216 on the right side of the figure tapers toward the discharge outlet 232 on the right side of the figure. Flow of pressurized fluid from the fluid inlet 234 and through the tapered nozzles 238 of the eductors 236 creates suction in the conduit 228 proximate exit ends of the eductors 236 (i.e., narrower ends of the tapered nozzles 238) due to the Venturi effect. Thus, by positioning the eductors 236 below or at the entrance of the coupling of the hopper 216 to the conduit 228, the pressurized fluid flow through the eductors 236 creates suction that draws the material collected by the hoppers 216 through the outlets 220 of the hoppers 216 and into the conduit 228. The fluid flow through the conduit 228 also helps move the material through the conduit 228 to the discharge ends 232.

In some embodiments, the eductors 236 may be removable from the conduit 228 and/or hoppers 216 by decoupling the eductor 236 from the conduit 228. Removable eductors 236 may allow for different sized eductors 236, i.e., eductors with differently sized tapered nozzles 238, to be coupled to the hoppers 216 and conduit 228 for providing a desired pressure differential across the eductor 236, and therefore suction to the hoppers 216.

Figure 5:
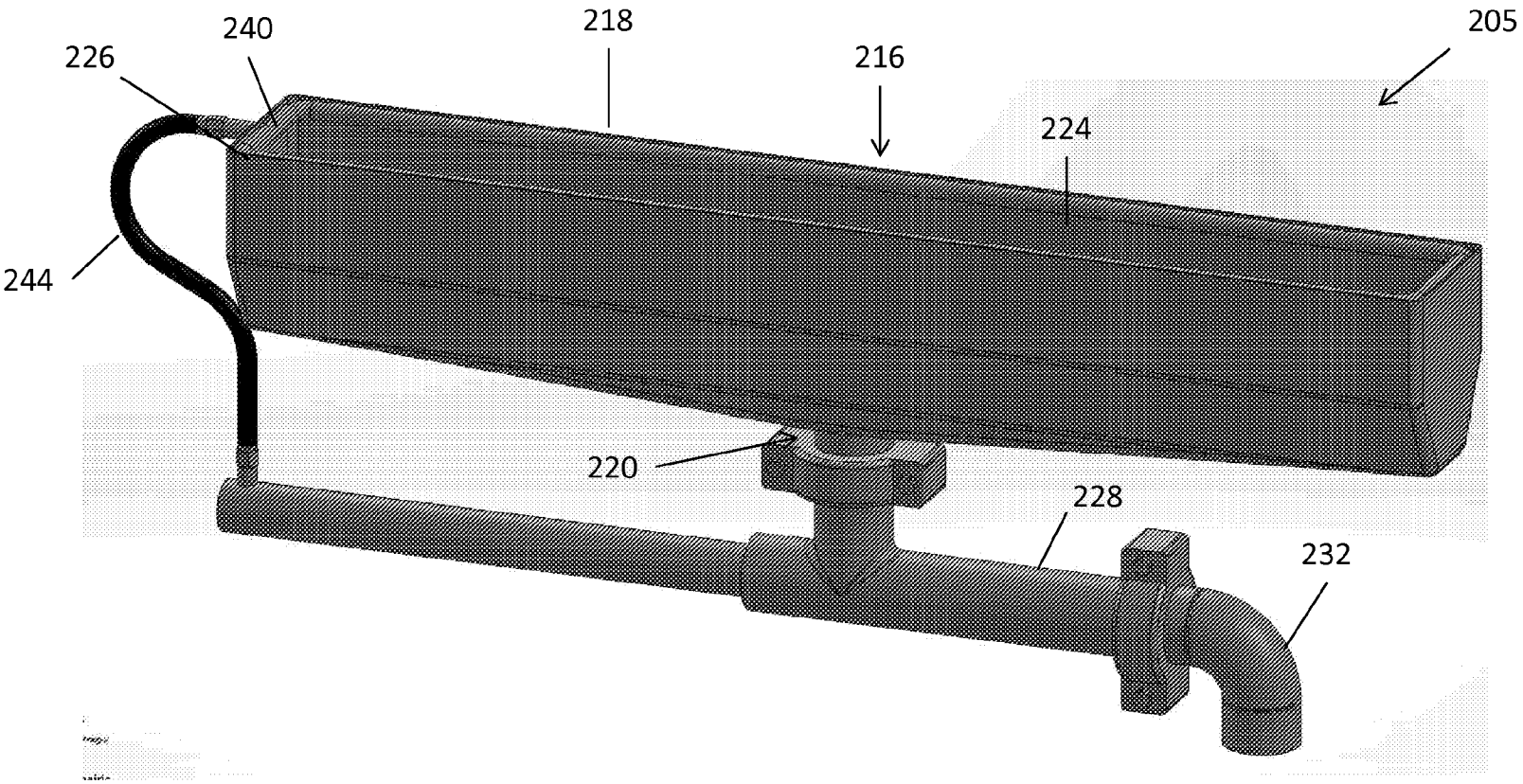
FIG. 5 is a perspective view of a collection trough in accordance with embodiments of the present disclosure.

Referring to FIG. 5, in some embodiments, hopper 216 may include a fluid inlet 240 configured to inject a fluid into the hopper 216. Fluid inlet 240 may be located proximate the inlet 218 or open end of the hopper 240. Fluid inlet 240 may be an opening, port, or nozzle formed or disposed in a side 224 or end 226 of the hopper 216. Fluid injected through the fluid inlet 240 into the hopper 216 may wet interior surfaces of the hopper 216 or provide a thin film to facilitate movement of the material in the hopper 216 downward to the outlet 220. The fluid injected into the hopper may be any fluid such as, for example, water, clean drilling muds, including water-based and oil-based muds, recycled or processed drilling muds, etc.

Figure 6:
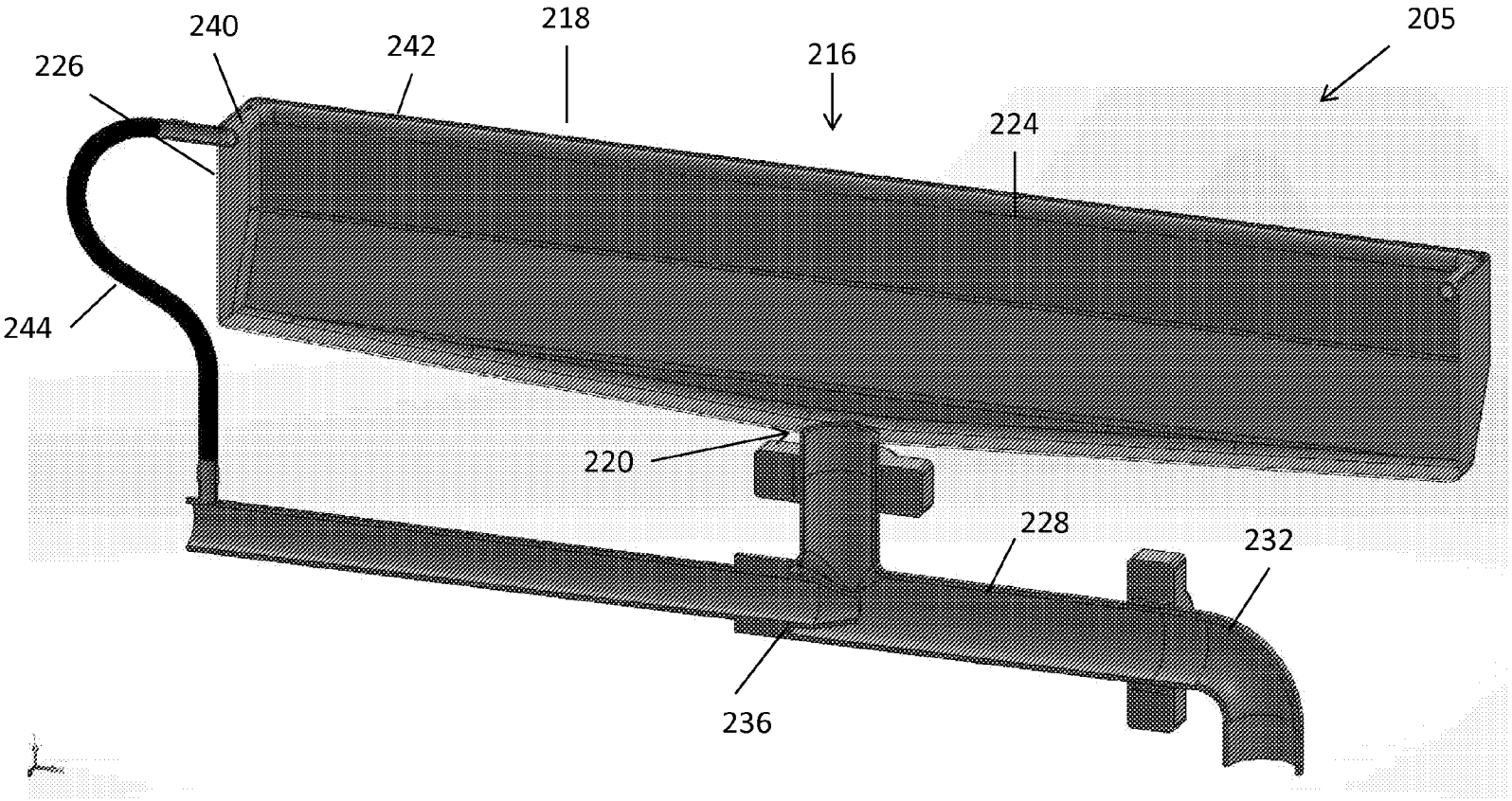
FIG. 6 is a cut away view of the collection trough of FIG. 5.

In some embodiments, as shown in greater detail in FIG. 6, fluid inlet 240 may include a fluid distribution apparatus 242 having a plurality of openings, ports, or nozzles. The fluid distribution apparatus 242 may be disposed proximate the inlet 218 of the hopper 216. The fluid distribution apparatus 242 may be disposed on an interior surface of the hopper 216 proximate a top surface of the hopper 216. For example, as shown in FIG. 6, fluid distribution apparatus 242 may be a ring, a hose, a tubular element, or the like, disposed in the hopper 216 along an interior perimeter of the hopper. The fluid distribution apparatus 242 may include a plurality of openings disposed at various locations along the perimeter of the hopper 216. Fluid from a fluid source enters through the fluid inlet 240 and through the fluid distribution apparatus 242 to more evenly distribute a flushing fluid to the hopper 216. In some embodiments, a flow rate of fluid through the fluid distribution apparatus 242 may be approximately 200 gallon per minute ("gpm"). In other embodiments, a flow rate of fluid through the fluid distribution apparatus 242 may be, for example, 1 gpm, 100 gpm, 150 gpm, or 250 gpm. One of ordinary skill in the art will appreciate that the flow rate of fluid is not intended to limit the scope of embodiments disclosed herein. The flushing fluid may wet interior surfaces of the hopper 216 or provide a thin film to facilitate movement of the material in the hopper 216 toward the outlet 220.

In some embodiments, fluid inlet 240 may be coupled to an external fluid source (not shown). A valve (not shown) may be connected between the external fluid source (not shown) and the fluid inlet 240 to control the flow of fluid into the hopper 216. In other embodiments, fluid inlet 240 may be fluidly coupled to an external fluid source through conduit 228. For example, as shown in FIG. 6, in one embodiment, a hose 244 or conduit may be coupled between fluid inlet 240 and conduit 228. In this embodiment, the hose 244 may be coupled to the conduit 228 upstream of eductor 236 positioned proximate the outlet 220 of the hopper 216. Thus, when fluid is injected through fluid inlet 234 (FIG. 4) into the conduit 228, a portion of the fluid flows through the hose 244 to the fluid inlet 240 of the hopper 216.

Although not shown for simplicity of the figures, one of ordinary skill in the art will appreciate that a hose 244 may be coupled between a second hopper 216 (such as that shown in FIG. 4) and the conduit 228, such that the hose is located upstream of one or more eductors 236. In other words, a separate hose 244 may be coupled between each hopper 216 of the collection trough 205 to the conduit 228. In other embodiments, a single hose 244 may be coupled to the conduit 228, upstream of one or more eductors 236, and to two hoppers 216. A valve (not shown) or splitter (not shown) may divide the flow of fluid from the single hose 244 coupled to the conduit 228 to the two hoppers 216.

While some embodiments have been described with respect to two hoppers, one of ordinary skill in the art will appreciate that in some embodiments, the collection trough may include a single collection container that may be divided into two or more chambers with, for example, a wall. In this embodiment, the collection container may include two or more outlets, one outlet for each chamber. In this way, each chamber may still be coupled to an eductor for facilitating movement of the collected materials (overflow) out of the chambers, into the conduit and through the discharge ends.

A method in accordance with embodiments of the present disclosure may include providing a flow of drilling fluid from a wellbore to a screening deck of a vibratory separator, separating the drilling fluid into a filtrate and an overflow, directing the overflow to a hopper of a collection trough coupled the screening deck, and creating a pressure differential proximate an outlet of the hopper, thereby flowing the overflow from the collection trough through an outlet pipe coupled to the outlet. The creating a pressure differential may include providing a fluid to an eductor coupled to the outlet of the hopper. The method may further include injecting a flushing fluid into the hopper proximate an inlet of the hopper. Further, the method may include creating a pressure differential proximate an outlet of a second hopper of the collection trough, thereby flowing the overflow from the second hopper through the outlet pipe coupled between the second hopper and the hopper.

Although only a few example embodiments have been described in detail above, those skilled in the art will readily appreciate that many modifications are possible in the example embodiments without materially departing from scope of embodiments described herein. Accordingly, all such modifications are intended to be included within the scope of this disclosure.

What is claimed:

1. An apparatus comprising:

a vibratory separator having a top deck, a middle deck, and a bottom deck; and a collection trough coupled to at least one of the top deck, the middle deck, and the bottom deck, the collection trough comprising:

a collection container having an inlet configured to receive a material retained on the at least one of the top deck, the middle deck, and the bottom deck and a sloped surface configured to guide the material from the inlet to an outlet of the collection container;

a discharge end opposite with respect to the inlet of the collection container such that a flow path is provided from the outlet of the collection container to the discharge end and through the discharge end, wherein the discharge end is configured to convey guided material from the outlet of the collection container; and a pressure differential generator, having a tapered nozzle with an exit end, positioned below the outlet of the collection container such that the exit end of the tapered nozzle is provided directly below the outlet of the collection container and within the flow path between the outlet of the collection container and the discharge end, when the collection trough is coupled to the at least one of the top deck, the middle deck, and the bottom deck.

2. The apparatus of claim 1, wherein the collection trough comprises a conduit coupled to the outlet of the collection container, the pressure differential generator coupled between the conduit and the outlet.

3. The apparatus of claim 2, wherein the pressure differential generator is an eductor.

4. The apparatus of claim 2, wherein the conduit comprises a fluid inlet located upstream of the pressure differential generator.

5. The apparatus of claim 2, wherein the collection container comprises a fluid inlet disposed proximate the inlet.

6. The apparatus of claim 5, wherein the fluid inlet of the collection container is fluidly coupled to the conduit.

7. An apparatus comprising:

a vibratory separation having deck with a screening surface; and a collection trough coupled to the deck, the collection trough comprising:

a hopper having an inlet and an outlet;

a conduit coupled to the outlet of the hopper such that a flow path is proved from the outlet of the hopper to the conduit, and an eductor coupled to the outlet of the hopper and having a tapered nozzle with an exit end, wherein the exit end of the eductor is provided within the flow path and directly below the outlet of the hopper when the collection trough is coupled to the deck, wherein the eductor is coupled to the conduit such that the eductor and the conduit form a continuous flow path.

8. The apparatus of claim 7, wherein the tapered nozzle tapers in a direction toward a discharge end of the conduit.

9. The apparatus of claim 7, wherein the collection trough further comprises:

a collection container having an inlet and an outlet, the conduit fluidly coupling the outlet of the hopper and the outlet of the collection container.

10. The apparatus of claim 9, wherein the conduit further comprises a fluid inlet located between the outlet of the hopper and the outlet of the collection container.

11. The apparatus of claim 9, wherein the collection trough further comprises a second eductor coupled to the conduit proximate the outlet of the collection container.

12. The apparatus of claim 9, wherein the eductor of the hopper and the eductor of the collection container are oriented oppositely.

13. The apparatus of claim 7, further comprising a hose fluidly coupled between the conduit and a fluid distribution apparatus disposed in the hopper.

14. A method comprising:

providing a flow of drilling fluid from a wellbore to a screening deck of a vibratory separator;

separating the drilling fluid into a filtrate and an overflow;

directing the overflow to a hopper of a collection trough proximal to the screening deck;

creating a pressure differential below an outlet of the hopper via pressure differential generator having a tapered nozzle with an exit end, wherein the exit end of the tapered nozzle is provided directly below the outlet of the hopper and within a flow path from the outlet of the hopper, and flowing the overflow from the collection trough through an outlet conduit coupled to the outlet of the hopper.

15. The method of claim 14, further comprising injecting a flushing fluid into the hopper proximate an inlet of the hopper.

16. The method of claim 14, wherein the creating the pressure differential comprises providing a fluid to the pressure differential generator comprising an eductor coupled to the outlet of the hopper.

17. The method of claim 14, further comprising creating a pressure differential proximate an outlet of a second hopper of the collection trough, thereby flowing the overflow from the second hopper through the outlet pipe coupled between the second hopper and the hopper.

18. The method of claim 14, further comprising:

forming a continuous conduit or flow path, via the pressure differential generator and the outlet conduit, by coupling the pressure differential generator between the outlet of the hopper and the outlet conduit.

* * * * *